US012385105B2

(12) United States Patent
Bindermagel et al.

(10) Patent No.: US 12,385,105 B2
(45) Date of Patent: Aug. 12, 2025

(54) APPARATUS FOR COOLING LONG PRODUCTS AND METHOD OF COOLING A LONG PRODUCT USING THE SAME

(71) Applicant: KOCKS Technik Gmbh & Co KG, Hilden (DE)

(72) Inventors: Ali Bindermagel, Solingen (DE); Ralf Dedeken, Wiehl (DE); Michael Kruse, Düsseldorf (DE); Mathias Schuck, Duisburg (DE)

(73) Assignee: KOCKS Technik GmbH & Co KG, Hilden (DE)

( * ) Notice: Subject to any disclaimer, the term of this patent is extended or adjusted under 35 U.S.C. 154(b) by 594 days.

(21) Appl. No.: 17/237,386

(22) Filed: Apr. 22, 2021

(65) Prior Publication Data

US 2021/0332456 A1 Oct. 28, 2021

(30) Foreign Application Priority Data

Apr. 24, 2020 (DE) ..... 10 2020 205 252.2

(51) Int. Cl.
*C21D 11/00* (2006.01)
*C21D 9/08* (2006.01)

(52) U.S. Cl.
CPC ..... *C21D 11/005* (2013.01); *C21D 9/085* (2013.01)

(58) Field of Classification Search
CPC ..... C21D 11/005; C21D 9/085; C21D 9/04; B21B 45/0215; B21B 45/0209;
(Continued)

(56) References Cited

U.S. PATENT DOCUMENTS 4,637,547 A * 1/1987 Hiniker ..... B05B 12/00 239/69
4,932,232 A * 6/1990 Ballyns ..... B05B 15/50 72/201

(Continued)

FOREIGN PATENT DOCUMENTS

CN 103464474 A 12/2013
CN 104148408 A 11/2014

(Continued)

OTHER PUBLICATIONS

CN207127227, Zhao et al. , Secondary Cooling Water Developments Distribution System For Continuous Casting,Mar. 23, 2018 (Year: 2018).*

(Continued)

*Primary Examiner* — Jessee R Roe
*Assistant Examiner* — Michael Aboagye
(74) *Attorney, Agent, or Firm* — Wolf, Greenfield & Sacks, P.C.

(57) ABSTRACT

An apparatus (100) for cooling long products is provided, the apparatus (100) having a coolant supply line (42) for supplying a coolant and a plurality of cooling devices (70), each connected to the coolant supply line (42) via an individually adjustable control valve (90), whose coolant delivery depends is each case on a degree of opening of the respective control valve (90), so that distribution of the coolant delivery along the travel direction can be flexibly adjusted by individually setting the degrees of opening of the control valves (90).

5 Claims, 1 Drawing Sheet

(58) Field of Classification Search
CPC ... B21B 45/0218; B21B 15/005; B21B 43/10; B21B 2045/0236
USPC ..... 266/259, 87, 89, 46, 81, 114, 79; 148/511, 664
See application file for complete search history.

(56) References Cited

U.S. PATENT DOCUMENTS

| | | | | |
|---|---|---|---|---|
| 5,907,967 | A | 6/1999 | Kleinefeldt et al. | |
| 7,854,883 | B2 * | 12/2010 | Kueppers | C21D 9/04 266/114 |
| 8,231,826 | B2 * | 7/2012 | Ueoka | B21B 45/0218 266/46 |
| 8,282,747 | B2 | 10/2012 | Oda | |
| 11,167,332 | B2 * | 11/2021 | Weinzierl | B21B 37/74 |
| 11,701,697 | B2 * | 7/2023 | Niitani | C21D 8/0263 266/46 |
| 11,745,237 | B2 * | 9/2023 | Alken | B21B 45/0233 72/13.4 |
| 2004/0187974 | A1 | 9/2004 | Kuppers et al. | |
| 2008/0018027 | A1 | 1/2008 | Kuppers et al. | |
| 2011/0107776 | A1 * | 5/2011 | Mallison | C21D 9/5735 62/103 |
| 2018/0345343 | A1 | 12/2018 | Chen et al. | |

FOREIGN PATENT DOCUMENTS

| | | | | | |
|---|---|---|---|---|---|
| CN | 203955734 | | * | 11/2014 | B21B 37/74 |
| CN | 104334754 | A | | 2/2015 | |
| CN | 206643135 | U | | 11/2017 | |
| CN | 207127227 | | * | 3/2018 | B22D 11/124 |
| CN | 109475912 | A | | 3/2019 | |
| DE | 10 2007 046 279 | A1 | | 4/2009 | |
| DE | 100 32 833 | B4 | | 4/2010 | |
| DE | 10 2012 215 599 | A1 | | 3/2014 | |
| EP | 0 882 804 | A1 | | 12/1998 | |
| EP | 2 274 113 | B1 | | 5/2013 | |
| EP | 3 395 463 | A1 | | 10/2018 | |
| JP | S57-120624 | A | | 7/1982 | |
| JP | S58-090314 | A | | 5/1983 | |
| JP | S61-249562 | | | 11/1986 | |
| JP | S62-093021 | A | | 4/1987 | |
| JP | H02-104458 | | | 4/1990 | |
| JP | H04-167916 | | | 6/1992 | |
| JP | H06-122015 | | | 5/1994 | |
| JP | H09-239423 | | | 9/1997 | |
| JP | H10-061819 | A | | 3/1998 | |
| JP | H10-314820 | A | | 12/1998 | |
| JP | H11-197729 | A | | 7/1999 | |
| JP | 2004-218953 | A | | 8/2004 | |
| JP | 2004-537649 | A | | 12/2004 | |
| JP | 2011-156575 | A | | 8/2011 | |
| KR | 10-0679081 | B1 | | 2/2007 | |
| KR | 10-2012-0001026 | A | | 1/2012 | |
| KR | 10-1290488 | B1 | | 7/2013 | |
| WO | WO 03/012151 | A1 | | 2/2003 | |
| WO | WO 2010/055067 | A1 | | 5/2010 | |
| WO | WO-2020020868 | A1 | * | 1/2020 | B21B 37/74 |

OTHER PUBLICATIONS

CN203955734, Su, Medium Plate Control Cooling Side Spraying System, Nov. 16, 2014 (Year: 2014).*
Office Action for Japanese Application No. 2021-073313, mailed Jun. 13, 2022.

* cited by examiner

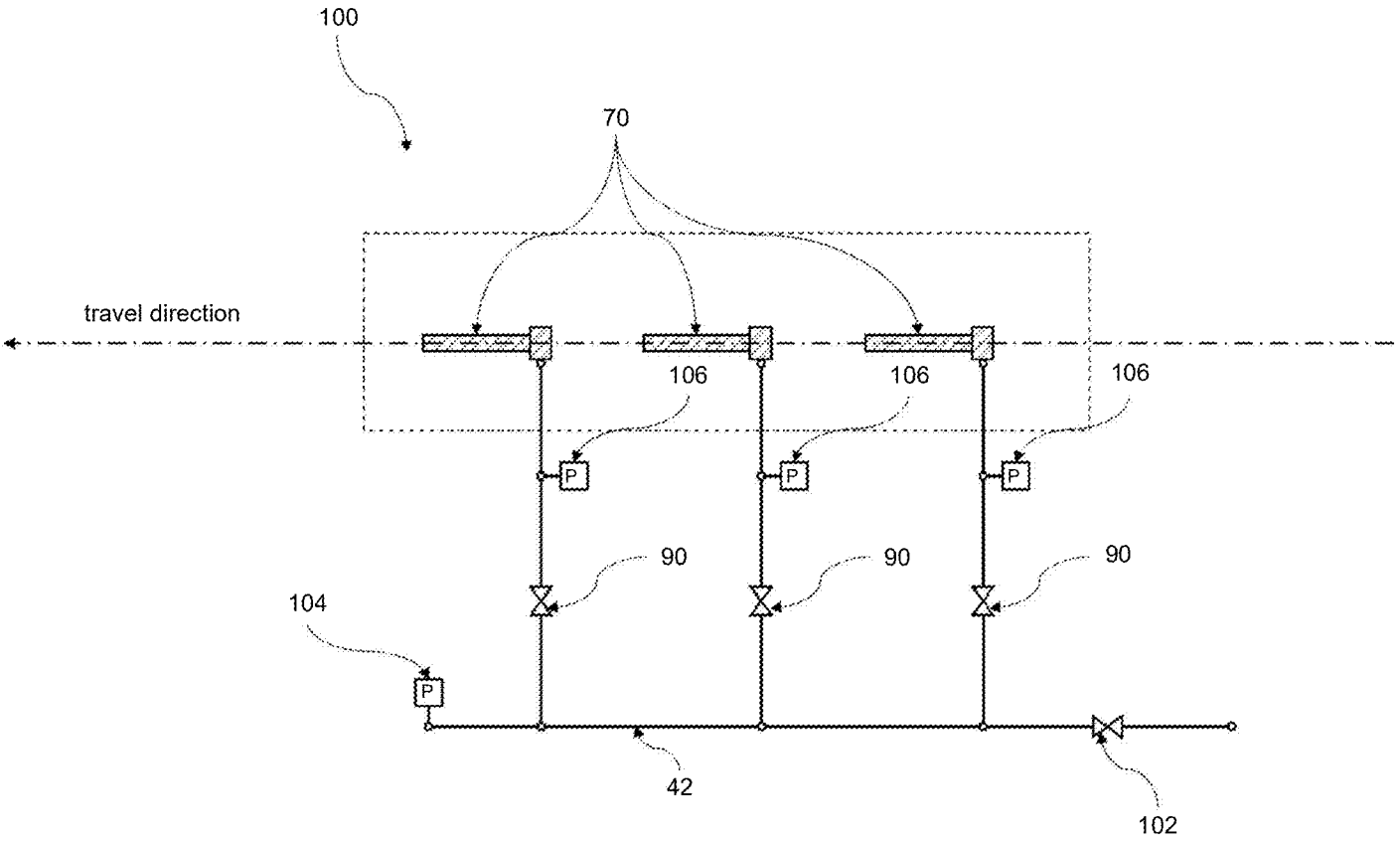
100
70
106
106
106
P
P
P
90
90
90
42
P
104
102
travel direction

APPARATUS FOR COOLING LONG PRODUCTS AND METHOD OF COOLING A LONG PRODUCT USING THE SAME

This Application claims priority to German application number 10 2020 205 252.2, filed Apr. 24, 2020. The entire contents of which is incorporated herein by reference in its entirety.

TECHNICAL FIELD

The present invention relates to an apparatus for cooling long products, a method for cooling a long product and a cooling device.

BACKGROUND

So-called cooling sections are used when rolling hot metal rods, wires and tubes. These cooling sections serve to influence the microstructure of the metal in a specific way through cooling of the hot rolled products. In rolling mills, such cooling sections are disposed at various positions before or after individual rolling stands of a rolling train and usually consist of a water box and a subsequent equalising section. The water box serves to cool the long product. Since cooling is achieved by cooling the surface of the rolled product, an equalising section is normally disposed after a water box, in which the reduced surface temperature equalises with the temperature in the interior of product.

For the purposes of this disclosure, long products are semi-finished metal products produced by rolling, drawing or forging with a constant cross-section over their length, which are not flat products because their length is much greater than their thickness/height and width. In particular, this includes rods, wires, tubes and profiles.

For the purposes of this disclosure, a processing line or a rolling line is understood to be a substantially straight path or section of path along which a long product is able to travel in the processing apparatus.

On its way through the cooling section, the long product passes through different cooling and equalising sections. Excessive cooling of the surface without the provision of an equalising section would cause the surface to, as it were, "freeze", while the interior of the material remains at a high temperature, which can lead to the end product having an inadequate microstructure.

The microstructure of the end product is thus influenced in particular by the cooling regime. This means, firstly, that the said equalising sections must be provided after each cooling device and, secondly, that a plurality of cooling devices may need to be provided with equalising sections disposed between them. This further means that the cooling of the long product in the cooling sections must be finely controlled as it passes through the apparatus in order to realise the desired cooling process. The required cooling differs depending on the requirements placed on the end product.

For this reason, cooling sections are equipped with a plurality of cooling devices, each of which is supplied with coolant, which they deliver to the surface of the long product passing therethrough in order to cool it.

For example, document EP 2 274 113 E1 discloses an apparatus for the controlled cooling of hot-rolled sheet or strip metals by means of a plurality of cooling devices. However, EP 2 274 113 E1 on the one hand does not disclose any possibility of cooling of long products in a controlled way. On the other hand, there is no possibility disclosed in the prior art of individually controlling the cooling state of individual areas along the travel direction of the rolled product.

Such control or regulation of the cooling state of individual areas may however be necessary, for example in order to influence the microstructure in the desired way through a controlled and/or regulated cooling regime.

Furthermore, it is especially desirable in the case of long products in particular to provide an even cooling state over the whole extent of the long product. The inventors of the present application have recognised that uneven cooling along its extent results in different microstructures, which is not shown in the prior art.

In order to obtain an optimal cooling result, it is important that the cooling section is adapted to the long product to be cooled: In a cooling section, there are usually a plurality of annular cooling devices, for example cooling nozzles, disposed coaxially one after the other, and one or more water stripping nozzles, through which the hot rolled stock passes centrically. So much water is injected into these cooling nozzles through an annular gap that the cooling tube fills completely. The water volume is usually of the order of 50 $m^3/h$. It is essential that the rolled stock is guided as centrically as possible through the cooling tube in order to obtain an even cooling result over the whole circumference of the rolled stock.

It is also important that the annular gap filled with coolant between the rolled stock and the cooling tube is not larger or smaller than a certain size. For this reason, it is necessary to use a plurality of cooling devices with different internal diameters, each of which is suitable for different rolled stock cross-sections. For example, three different cooling tube diameters are needed to cover a product spectrum for rolled stock with diameters ranging from 20 mm to 100 mm in acceptable quality.

It has been found expedient to provide a plurality of cooling sections, each suitable for a certain rolled stock cross-section, which are interchangeable in such a way that they can be quickly installed and removed on a processing line in the event of a product change. As product changes can occur several times a day, the speed of such a changeover process is of decisive importance for the efficiency of the rolling train, as the rolling train has to be shut down during this time.

Due to different product requirements, in a hot rolling train for long products, the whole product program of an inline thermal treatment is not always applied. For example, it may be that only a part of the cooling devices provided in a cooling section is needed to cool the long product.

Moreover, it may be necessary to set different coolant flow rates for different long product diameters to take account of the dimensions and heat capacity of the long product. This requires fairly fine adjustment of the coolant volume delivered by the cooling devices. However, the adjustability of such valves depends on the operating point of the valve. For example, controlling a volume flow within small volume ranges will be far less stable with one DN200 valve than with a plurality of DN65 valves.

Another problem in the prior art is the uneven cooling of long products across their diameter. Coolant is usually applied to the long product through nozzle gaps in order to cool it. However, this has the effect that, at the point where the cooling water impinges on the long product, strong cooling takes place which may lead to the formation of hardening structures at the impingement point, whereas at other points along the extent of the long product, less cooling takes place, so that the cooling state along the extent of the long product is uneven. In the opinion of the inventors of the present application, such unevenness leads to undesirable microstructural conditions and thus undesirable material properties of the end product.

SUMMARY OF THE INVENTION

Against this background, an object of the present invention is to provide an apparatus for cooling long products that is able to set a microstructure in a hot-rolled long product as flexibly as possible.

According to a first aspect of the present invention, an apparatus is provided for cooling long products along a travel direction. The apparatus has a coolant supply line for supplying a coolant and a plurality of cooling devices, each connected to the coolant supply line via an individually adjustable control valve, whose coolant delivery depends in each case on a degree of opening of the respective control valve, so that distribution of the coolant delivery along the travel direction can be flexibly adjusted by individually setting the degrees of opening of the control valves.

The coolant is preferably water.

The cooling devices serve to apply coolant to the long product to be cooled. As each of the cooling devices is connected to the coolant supply line via an individually adjustable control valve, the coolant delivery to the long product by each such connected cooling device can be adjusted by adjusting the degree of opening of the respective control valve.

The term "coolant delivery" in this context means a coolant flow rate, i.e. a coolant volume per unit of time.

In this context, a control valve means a valve which, in a range around its operating point, is able to adjust the coolant volume passing through the valve by changing its degree of opening.

In this context, "distribution of the coolant delivery" means that, for a given coolant delivery supplied by the coolant supply line, the proportion of the delivered coolant deliveries allocated to the individual cooling devices is determined by the individual settings of the respective control valves.

When the cooling devices are disposed along the travel direction of the long product, a cooling regime adapted to a required microstructure of the long product can thus be set by controlling or regulating the control valves in different areas of the long product or in different areas of the cooling apparatus.

Providing a plurality of adjustable or controllable valves allows finer adjustment of the cooling state than would be possible with a single central valve. Whereas in a conventional apparatus the coolant delivery of the cooling devices is centrally controlled by a single valve, by providing a plurality of control valves on the individual cooling devices, the cooling state can be precisely adjusted: A central control valve which, for example, controls the total coolant delivery over a cooling section by a plurality of cooling devices, is necessarily designed for an operating range in a volume flow range that is sufficient to supply all cooling devices with both a maximum coolant flow and a minimum coolant flow. However, such a large operating range means that fine adjustment of the coolant rate is not possible over the entire volume range from minimum coolant flow to maximum coolant flow. In contrast, providing multiple control valves, each of which only affects the rate of coolant supplied to a single cooling device, has the advantage that each of the individual control valves has a narrower operating range within which the amount of coolant supplied can be more accurately adjusted. In other words, better control of the cooling states along the travel direction can be achieved by having a plurality of individual control valves each with a narrower operating range than with a central valve with a wider operating range.

Preferably, the degree of opening of at least one control valve and preferably of a plurality of control valves is continuously adjustable.

Continuous adjustability in this context means any kind of continuous adjustment within the usual manufacturing and control tolerances.

In particular, this means that the control valve is a valve which, in addition to the fully closed setting and the fully open setting, has at least one range in which changing the degree of opening of the control valve causes a continuous change in the resulting flow rate.

Preferably, the total coolant delivery from the cooling devices is equal to the total coolant supplied from the coolant supply line.

This means that the total amount of coolant suppled by the coolant supply line is divided among the cooling devices. On the one hand, this has the effect that the distribution of the total coolant flow to the individual coolant devices is adjusted by setting the degrees of opening of the control valves of the coolant devices. On the other hand, this has the effect that the overall cooling capacity of the cooling apparatus can be defined by adjusting the total coolant flow in the coolant supply line, the exact distribution to the individual areas being determined by the control valves on the cooling devices.

The coolant supply line preferably has a shut-off valve to either allow or prevent the supply of coolant through the coolant supply line to the cooling devices at a defined coolant rate.

A shut-off valve means in particular an "on-off valve", i.e. a valve that has precisely two settings, namely an open setting whereby the defined flow rate is allowed to pass through the valve, and a shut-off setting whereby a volume flow is completely prevented.

In particular, the term "shut-off valve" is used herein to distinguish it from the term "control valve": whereas, by opening the valve very slowly, a shut-off valve also allows a flow rate to pass through which corresponds neither to the defined flow rate described above nor to a zero flow in the shut-off state, it is clear to the person skilled in the art that such valves are nevertheless not control valves in the sense of the disclosure, because the intermediate states between fully open and fully closed are undefined.

The apparatus preferably further comprises a measuring device for measuring a pressure of the coolant in the coolant supply line and/or a measuring device for measuring a pressure of the coolant between a control valve and the respective cooling device and/or a measuring device for measuring a temperature of a long product in transit, i.e. in the apparatus.

By measuring coolant pressures by means of such measuring devices upstream and/or downstream of the control valve, especially if the characteristic curve of the control valve and/or the degree of opening of the control valve is known, conclusions can be drawn about the coolant delivery set by the control valve, which can be used to regulate, control or set a cooling state.

A temperature of the workpiece measured by a temperature measuring device, in particular a temperature at a point to be influenced by a cooling of a cooling device, can serve as a basis for setting the amount of coolant supplied to the cooling device.

The cooling devices are preferably disposed one after the other in the travel direction in order to cool one area of the long product at a time along the travel direction.

By arranging a plurality of cooling devices one after the other, the workpiece can, for example, be cooled to a first surface temperature by a first cooling device, then have its surface temperature equalised with the core temperature in an equalising section, then be cooled to a second surface temperature by a second cooling device, and so on. Through such an arrangement of a plurality of cooling devices one after the other, strong heat dissipation can be realised without the surface of the long product being cooled by an individual cooling device to such an extent that an unwanted microstructure occurs.

The apparatus preferably further comprises a measuring device for determining a position of a long product in transit, i.e. in the apparatus.

By determining the position of the long product, the cooling regime can be adapted to the workpiece if the dimensions of the long product are known. Moreover, by determining the position it is possible, for example, to turn off those cooling devices in which there is currently no long product to be cooled, thereby helping to make the apparatus more energy efficient and environmentally friendly.

According to another aspect of the present invention, a method is provided for cooling a long product using an apparatus as described above, such method comprising the following steps:

specifying a temperature of a long product at a position the travel direction;

measuring a temperature of the long product at a position along the travel direction; and setting a coolant delivery rate of a cooling device based on a comparison between the specified temperature and the measured temperature, in order to set a cooling state n an area of the long product.

The two positions along the travel direction at which a temperature is specified and measured are preferably the same position. However, this is not necessarily required. For example, by knowing the material characteristics, from a temperature measured at a first position it is possible to infer the temperature at another position.

A cooling state can be, for example, the amount of coolant applied to an area of the long product per unit of time. However, the cooling state can also be defined in another way, for example based on a defined heat dissipation amount of the long product or based on a coolant quantity or heat dissipation amount standardised to an area or volume of the long product.

The position at which the temperature is measured can be disposed both before and after the cooling device in the travel direction of the long product. With measurement before the cooling device, the method can be interpreted as a control method, whereas with measurement after the cooling device, the method can be interpreted as a regulation (feed-back controlled) method, the difference between the specified temperature at a certain position and a measured temperature being interpreted as a control deviation of a control loop, on the basis of which the coolant delivery by the control valve associated with the cooling device is adjusted, the adjustment of the coolant delivery preferably involving an adjustment of the degree of opening of a respective control valve.

The coolant delivery is preferably adjusted using a characteristic curve of the control valve. While exact knowledge of the characteristic curve is not absolutely necessary for regulation or control according to the above method, knowledge of the characteristic curve of the control valve allows more precise adjustment of the degree of opening. However, if the exact characteristic curve of the control valve is not known, an estimated characteristic curve or an estimated response behaviour can also be used to adjust the control valve.

The coolant delivery is preferably adjusted using a pressure measured in the coolant line and/or a pressure measured between the control valve and the cooling device.

Using one of these parameters increases the accuracy of the cooling state setting, especially if the characteristic curve of the control valve is known.

The coolant delivery rate is preferably adjusted using a temperature of the long product before the cooling device and/or a temperature of the long product after the cooling device.

As explained above, such an adjustment allows the coolant delivery to be controlled or regulated. In particular, when using the temperature both before and after the cooling device, the coolant delivery can be set particularly precisely, as conclusions can be drawn about the cooling capacity of the cooling device based on the temperature difference across the cooling device.

The coolant delivery is preferably adjusted in real time. This allows a prompt and timely reaction to deviations from a desired cooling state.

The coolant delivery is preferably adjusted by a control or regulating device, in particular an electronic control or regulating device. An electronic control or regulating device can be provided, for example, by a computer that processes the measurement data and adjusts the control valves based on this processed data together with data previously stored in the computer.

The coolant delivery is preferably adjusted based on a certain position of the long product along the travel direction.

As explained above, position-dependent adjustment of the coolant delivery on the one hand enables more precise adjustment of the cooling state to the dimensions of the long product and the requirements placed on the end product and, on the other hand, saves coolant if there is no long product in the area of the cooling device.

Further advantages and further developments of the invention are apparent from the following description of the figures and from the totality of claims.

BRIEF DESCRIPTION OF FIGURES

FIG. 1 is a schematic circuit diagram of a cooling apparatus according to one embodiment of the present invention.

WAYS TO CARRY OUT THE INVENTION

FIG. 1 schematically illustrates a circuit diagram of a cooling apparatus according to one embodiment of the present invention.

An apparatus 100 for cooling long products according to one embodiment of the present invention comprises a plurality of cooling devices 70. The cooling devices can, for example, be disposed one after the other along a travel direction of a long product passing through the apparatus. However, the invention is not limited to such a configuration. For example, the cooling devices 70 can also be disposed on several independent processing lines in order to cool different long products.

In the apparatus 100 for cooling long products shown in FIG. 1, a travel direction for long products is defined by the apparatus 100. The apparatus has a coolant supply line 42 for supplying a coolant and a plurality of cooling devices 70 each connected to the coolant line 42 via an individually adjustable control valve 90, the coolant delivery rate of each of which depends on a degree of opening of the respective control valve 90, so that the coolant rate can be flexibly distributed along the travel direction by adjusting the degrees of opening of the control valves 90.

The cooling devices 70 are each connected to a coolant line 42 via a control valve 90. Each control valve 90 is configured to continuously control, within its control range, a coolant rate delivered from the coolant line 42 to the cooling device 70.

In the embodiment shown, three cooling devices 70 are disposed one after the other in a travel direction. However, the invention is not limited to this: firstly, the number of cooling devices 70 can be varied. For example, embodiments with seven cooling devices 70 have proven successful. Secondly, not all of the cooling devices 70 supplied by one coolant supply line 42 need to be disposed on the same processing line; rather, it is also possible for a coolant supply line 42 to supply coolant to a plurality of processing lines by disposing the cooling devices 70 on a plurality of different processing lines for long products, in which case the coolant supplied by the coolant supply line 42 to the different processing lines is distributed by adjusting the degree of opening of the control valves 90.

The coolant supply to the coolant supply line 42 can be allowed and prevented by a shut-off valve 102. The shut-off valve 102 may, for example, be a ball valve or other valve that either allows or prevents a volume flow of the coolant.

The pressure of the coolant in the coolant supply line 42 can be measured by a pressure measuring device 104.

A pressure measuring device 106 can measure a respective pressure of the coolant after each control valve 90. In this context, "after" each control valve 90 means a position lying downstream of the control valve 90 in the flow direction of the coolant. In the embodiment shown in FIG. 1, this position is between a control valve 90 and the respective cooling device 70. At the same time, however, other configurations of the arrangement of the pressure measuring device 106 are also possible; for example, the pressure measuring device 106 can be disposed within the cooling device 70.

Each pressure measuring device 106 can thus measure a pressure of the coolant to be delivered by the cooling device 70 towards the long product. The pressure measuring device 104 can measure a pressure prevailing in the coolant supply line 42, i.e. before each control valve 90. By calculating the difference between the pressure measured by the pressure measuring device 104 and the pressure measured by one of the pressure measuring devices 106, it is possible to determine a decrease in pressure across a respective control valve 90. The pressure measured by the pressure measuring device 106 correlates with a coolant rate delivered by the cooling device 70, so that this can be determined from the pressure difference.

By individually adjusting the degree of opening of each individual control valve 90, a distribution or the coolant rate to the individual cooling devices 70 can thus be set for a given coolant rate through the coolant supply line 42. As a result, a long product passing through the apparatus 100 along the travel direction can be cooled in different areas of the apparatus 100 at different coolant rates. For example, the long product may be weakly cooled in a first cooling device 70 in the travel direction by a low rate of coolant delivered by said first cooling device 70 and then more strongly cooled in a subsequent cooling device 70 in the travel direction by a higher rate of coolant delivered by said cooling device 70. Since the long product moves along the travel direction, the cooling rates can be adjusted over time through local fine adjustment of the coolant rates in the apparatus 100 in relation to the long product passing through. While such an adjustment can also be estimated in principle on the basis of operating parameters, it is preferable to provide a device for measuring or determining the position of the long product passing through the apparatus in order to thereby determine the position of the long product, whereby the temperature change in the long product over time can be more finely adjusted.

The specific setting of the temperature change over time depends on the requirements placed on the end product.

LIST OF REFERENCES

42 Coolant supply line
70 Cooling device
90 Control valve
100 Apparatus
102 Shut-off valve
104 Pressure measuring device
106 Pressure measuring device

The invention claimed is:

1. Apparatus for cooling long products along a travel direction, the apparatus comprising: a coolant supply line for supplying a coolant, a plurality of cooling devices, each connected to the coolant supply line via an individually adjustable control valve, a coolant delivery from the cooling devices, of which depends in each case on a degree of opening of the respective control valve, and equalizing sections provided between every two of the plurality of cooling devices for equalizing a surface temperature with a core temperature of the long products, so that distribution of the coolant delivery along the travel direction can be flexibly adjusted by individually setting the degrees of opening of the control valves, wherein the coolant supply line comprises a shut-off valve to open or shut off coolant from the coolant supply line to the cooling devices and wherein the apparatus further comprises a measuring device for measuring a pressure of the coolant in the coolant supply line and a measuring device for measuring a pressure of the coolant between one of the control valves and the respective cooling device, wherein the control valves are flexibly adjusted based on the measured pressure of the coolant in the coolant supply line and the measured pressure of the coolant between one of the control valves and the respective cooling device; wherein the apparatus further comprises a measuring device for determining a position of the long products along the travel direction.

2. Apparatus according to claim 1, wherein the degree of opening of at least one control valve is continuously adjustable.

3. Apparatus according to claim 1, wherein the coolant supplied from the coolant supply line is entirely delivered by the cooling devices.

4. Apparatus according to claim 1, wherein the apparatus further comprises a measuring device for measuring a temperature of one of the long products in the apparatus.

5. Apparatus according to claim 1, wherein a plurality of cooling devices are disposed one after the other in the travel direction in order for each to cool an area of the long products along the travel direction.

* * * * *